US006402590B1

(12) United States Patent
Neston et al.

(10) Patent No.: US 6,402,590 B1
(45) Date of Patent: Jun. 11, 2002

(54) CARRIER HEAD WITH CONTROLLABLE STRUTS FOR IMPROVED WAFER PLANARITY

(75) Inventors: Stephen A. Neston, Orlando; Edward A. Rietman, Gotha, both of FL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/594,139

(22) Filed: Jun. 14, 2000

(51) Int. Cl.[7] ..... B24B 1/00; B24B 49/00; B24B 51/00

(52) U.S. Cl. ..... 451/9; 451/41; 451/288; 451/398

(58) Field of Search ..... 451/8, 9, 10, 41, 451/59, 285, 287, 288, 289, 290, 397, 398; 29/428

(56) References Cited

U.S. PATENT DOCUMENTS

| | | | | |
|---|---|---|---|---|
| 5,240,552 A | | 8/1993 | Yu et al. | |
| 5,868,896 A | * | 2/1999 | Robinson et al. | 451/289 |
| 5,944,580 A | * | 8/1999 | Kim et al. | 451/9 |
| 6,056,630 A | * | 5/2000 | Nanda et al. | 451/287 |
| 6,143,123 A | * | 11/2000 | Robinson et al. | 451/289 |

* cited by examiner

*Primary Examiner*—Timothy V. Eley
(74) *Attorney, Agent, or Firm*—Hitt, Gaines & Boisbrun

(57) ABSTRACT

The present invention provides a polishing apparatus comprising a carrier head, rigid members coupled to the carrier head at different points on the carrier head, and a controller coupled to each of the rigid members wherein the controller is configured to regulate forces applied against the carrier head through each of the rigid members.

28 Claims, 2 Drawing Sheets

CARRIER HEAD WITH CONTROLLABLE STRUTS FOR IMPROVED WAFER PLANARITY

TECHNICAL FIELD OF THE INVENTION

The present invention is directed, in general, to a semiconductor wafer polishing apparatus and, more specifically, to a carrier head equipped with controllable struts that enable the force applied to the carrier head by each strut to be individually controlled.

BACKGROUND OF THE INVENTION

In the manufacture of microcircuit dies, chemical/mechanical polishing (CMP) is used to provide smooth topography on a substrate of a semiconductor wafers. A conventional wafer polishing apparatus comprises a carrier head, a carrier gimbal, a drive shaft, and a polishing platen. A semiconductor wafer is held within the carrier head while rotational and downward forces are applied to the semiconductor wafer through the drive shaft and against a polishing platen. The carrier gimbal is designed to allow for deviations from the horizontal between a wafer surface being polished and the polishing platen surface. The gimbal is effectively a universal joint between the drive shaft and the carrier head. Should there be a deviation of the platen surface from the horizontal at any point, the gimbal allows the carrier head to follow the contour of the local surface by tilting appropriately on either or both of two orthogonal, essentially-horizontal axes.

One problem that exists with the conventional gimbal design is that the gimbal design simply distributes the vertical force applied to the drive shaft to the surface of the semiconductor wafer. Therefore, if a given wafer is slightly thicker at one point on its edge than at another point, the thickness difference may persist as the planarization continues. That is, the gimbal assists in correcting local irregularities of the wafer surface, but does not correct for global irregularities of the semiconductor wafer.

Also, the nature of a given wafer may be that it planarizes faster in one sector than another. This results in a similar situation as described above, i.e., the semiconductor die on one sector of the wafer may be thinner or thicker than those on another sector of the same wafer.

Accordingly, what is needed in the art is an apparatus that permits adjustment of localized thickness of a semiconductor wafer for greater uniformity of the planarity of the semiconductor wafer during CMP.

SUMMARY OF THE INVENTION

To address the above-discussed deficiencies of the prior art, the present invention provides a polishing apparatus comprising a carrier head, rigid members coupled to the carrier head at different points on the carrier head, and a controller coupled to each of the rigid members wherein the controller is configured to regulate forces applied against the carrier head through each of the rigid members.

Thus, in a general sense, the present invention provides a polishing apparatus having a carrier head coupled to a drive system through rigid members that may be used to regulate forces applied against the carrier head at different points to more uniformly polish semiconductor wafers.

In one embodiment, the rigid members are struts. In an advantageous embodiment, the polishing apparatus further comprises sensors coupled to the carrier head proximate each of the different points and are configured to sense a force applied to the carrier head at each of the different points. In other embodiments, the sensors may be pressure sensors, force sensors, capacitance sensors, resistance sensors, or piezoelectric sensors. In another embodiment, the polishing apparatus further comprises a thickness sensor configured to sense a thickness of a desired layer on a semiconductor wafer.

Each of the rigid members, in another embodiment, may be coupled to a mechanical screw configured to provide a force against the carrier head. In a further aspect of this embodiment, each of the rigid members includes the mechanical screw. The mechanical screw may be coupled to a motor that provides rotation to the mechanical screw. The motor is preferably coupled to the controller.

In an alternative embodiment, each of the rigid members is coupled to a pneumatic cylinder configured to provide a force against the carrier head. In a further aspect of this embodiment, the pneumatic cylinder is coupled to a pneumatic system that provides the force. In yet another embodiment, each of the rigid members is coupled to a hydraulic cylinder configured to provide a force against the carrier head. The hydraulic cylinder is preferably coupled to a hydraulic system that provides the force.

In another embodiment, each of the rigid members is coupled to a piezoelectric transducer configured to provide a force against the carrier head. The piezoelectric transducer may be coupled to an electrical system either contracts or expands the piezoelectric transducer to provide the force against the carrier head.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
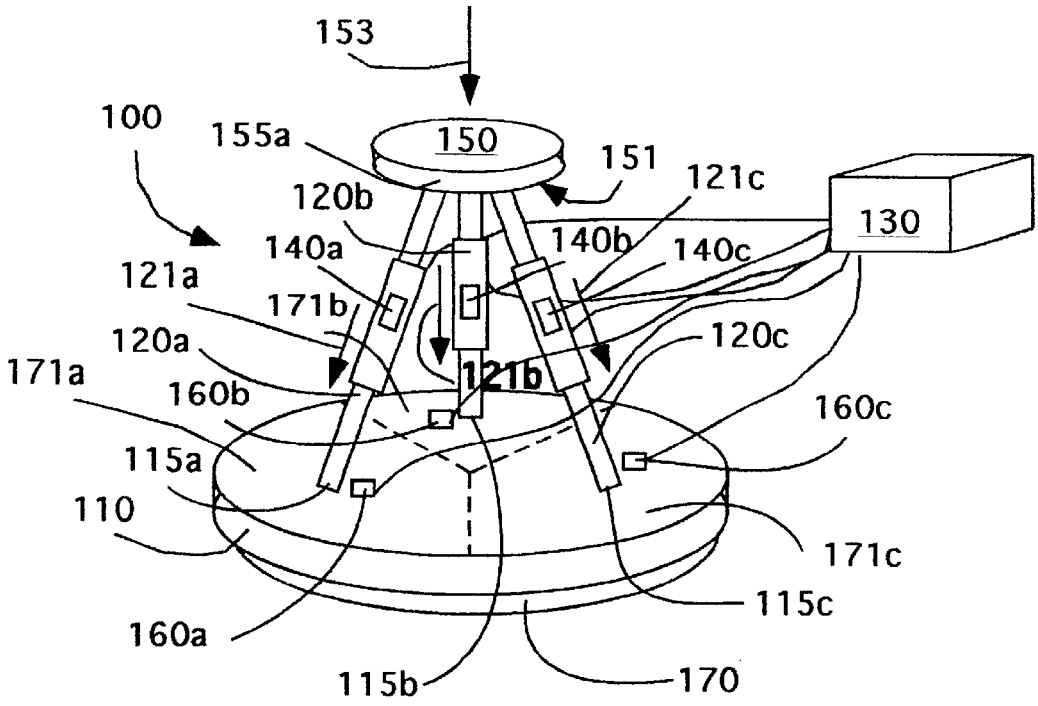
FIG. 1 illustrates one embodiment of a polishing apparatus constructed according to the principles of the present invention.

Referring initially to FIG. 1, illustrated is one embodiment of a polishing apparatus 100 constructed according to the principles of the present invention. The polishing apparatus 100 comprises a carrier head 110; rigid members 120*a*–120*c*, collectively designated 120; a controller 130; sensors 140*a*–140*c*, collectively 140; a drive flange 150, and thickness sensors 160*a*–160*c*, collectively 160. Shown in the carrier head is a semiconductor wafer 170 which has been prepared for planarization.

For the purposes of this discussion, the definition of the term "strut," as broadly construed, is taken from Merriam Webster's Collegiate Dictionary, Tenth Edition, as: "a structural piece designed to resist pressure in the direction of its length." Thus, the rigid members 120*a*–120*c* may also be termed struts 120*a*–120*c*. A strut may, in various embodiments, comprise various auxiliary components, such as: a turnbuckle, a mechanical screw/nut combination, hydraulic or pneumatic cylinders, piezoelectric transducers, sensors, etc. Such configurations will be discussed below. It should also be noted that those who are skilled in the art will readily be able to construct the various mechanical devices that are generally described herein and couple them to the controller such that incremental adjustments can be made to the pressure applied to each strut.

Moreover, the sensors 160 may be used to determine the planarity of the surface being polished. For example, with force readings taken from each of the sensors 160, comparative readings of a greater force being exhibited in sensor 160*b* than in sensors 160*a*, 160*c* could be interpreted that the surface is uneven, which, of course, would result in a non-planar surface. Thus, this information can be used to adjust or correct for the non-planarity of the surface. With continuous feedback, the variation between areas 171*a*–171*c* may be minimized.

The struts 120 are coupled at the lower ends thereof to the carrier head 110 at different points 115*a*–115*c*, collectively designated 115, on the carrier head 110. Upper ends of the struts 120 are additionally coupled to the drive flange 150 at points 155*a*–155*c*. While the struts 120 are shown coupled to the drive flange 150 at an angle and at virtually one point of attachment, it should be understood that the size of the drive flange 150 may be increased so as to couple the struts 120 normal to an attachment surface 151 of the drive flange 150. Of course, the struts 120 will not couple at a single point 155 on the drive flange 150 in that configuration.

The controller 130 is coupled to the thickness sensors 160*a*–160*c* so as to determine wafer thickness in areas 171*a*–171*c*, respectively. In the illustrated embodiment, the thickness sensors 160 may be piezoelectric sensors that are actively monitoring a thickness of one or more layers of the semiconductor wafer 170 under areas 171*a*–171*c*. The details of such in situ monitoring of semiconductor wafer layer thicknesses are detailed in U.S. Pat. No. 5,240,552 to Yu et al, which is incorporated herein by reference.

The controller 130 is further coupled to each of the struts 120*a*–120*c* and to each of the sensors 140*a*–140*c*. The controller 130, through the sensors 140, is configured to sense strut forces 121*a*–121*c*, collectively designated 121, applied against the carrier head 110 through each of the struts 120*a*–120*c*, respectively. The controller 130, based upon the thicknesses sensed for areas 171*a*–171*c*, then adjusts and controls the strut forces 121*a*–121*c* individually so as to achieve a desired planarity. Therefore, a flange force 153 applied during chemical/mechanical planarization (CMP) may be resolved into strut forces 121*a*–121*c* at individual struts 120*a*–120*c*, respectively. One who is skilled in the art is familiar with the principles of mechanics that involve resolving a single force into forces in multiple struts and also would understand how to connect the controller to the struts to appropriately control them. While the illustrated embodiments show three struts, one who is skilled in the art will recognize that finer control of wafer thickness and planarity may likely be obtained by a greater number of struts, e.g., four, six, etc.

Figure 2:
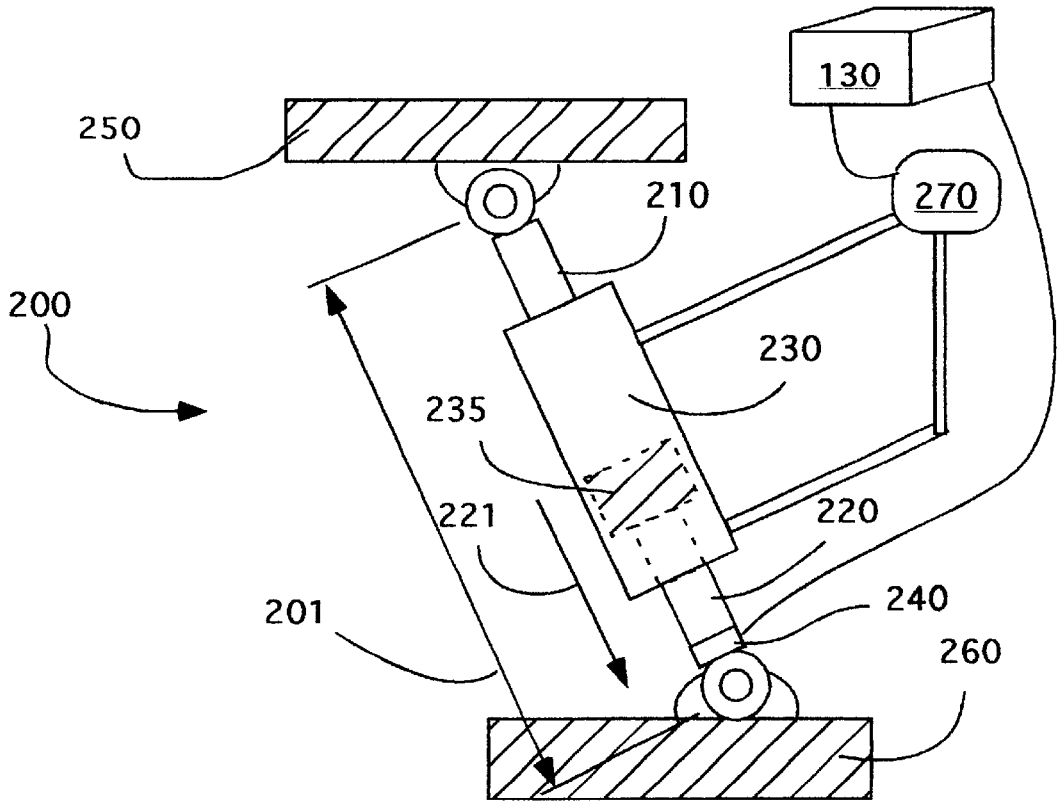
FIG. 2 illustrate an enlarged view of one embodiment of a single hydraulic/pneumatic strut with attachment to a drive flange and carrier head.

The struts of FIG. 1 may employ hydraulic, pneumatic, piezoelectric or mechanical systems to create the required forces. Referring now to FIG. 2, illustrated is an enlarged view of one embodiment of a single hydraulic/pneumatic strut 200 with attachment to a drive flange 250, carrier head 260 and a hydraulic/pneumatic system 270. The controller 130 is coupled to the hydraulic/pneumatic system 270. The hydraulic/pneumatic strut 200 comprises an upper section 210, lower section 220, a hydraulic/pneumatic cylinder 230 having a piston 235, and sensor 240.

One who is skilled in the art is familiar with the interchangeability of hydraulic and pneumatic systems. Because of the high degree of cleanliness required in the semiconductor manufacturing industry, a system that avoids the possibility of liquid contamination is preferred for this industry. Thus, in semiconductor wafer manufacturing, a pneumatic system, perhaps even using an inert gas, would be preferred over a hydraulic system. Therefore, further references will be directed solely to pneumatic cylinders/systems while fully recognizing that in other industries to which this invention may be applicable, hydraulic systems may be acceptable. The pneumatic system 270 is coupled to the strut 200 at the hydraulic/pneumatic cylinder 230. In the illustrated embodiment, the sensor 240 is a pressure sensor coupled to the carrier head 260 through the strut 200. Alternatively, the sensor 240 may be coupled to the cylinder 230 to read the pressure therein.

The length 201 of the strut 200 may be controlled by the controller 130 directing pressure from the pneumatic source 270 to the pneumatic cylinder 230. In lieu of a sensor 240, the controller 130 may directly read a pressure in the pneumatic cylinder 230, and combine the pressure with the area of the piston 235 to deduce the force 221 in the strut 200.

Referring now simultaneously to FIGS. 1 and 2, assume that the controller 130 detects that an area 171*b* of the wafer 170 under strut 120*b* is thicker than areas 171*a* or 171*c* under struts 120*a* and 120*c*, respectively. The controller 130 may therefore adjust the forces 121*a*–121*c* within the struts 120*a*–120*c* by increasing or decreasing the pressure within the pneumatic cylinder 230. The controller 130, sensing that area 171*b* is planarizing at a slower rate than areas 171*a* or 171*c*, commands an increase in the force 121*b* in strut 120*b* that is achieved by increasing pneumatic pressure in the pneumatic cylinder 230. Therefore, increased force 121*b* will increase the rate of removal in area 171*b*.

The sensors 240 may be pressure sensors, force sensors, capacitance sensors, resistance sensors, or piezoelectric sensors, as required. The sensors 240 are coupled to the controller 130 that is, in turn, coupled to the struts 120 in such a manner as to create the desired forces 121 in the struts 120.

Figure 3:
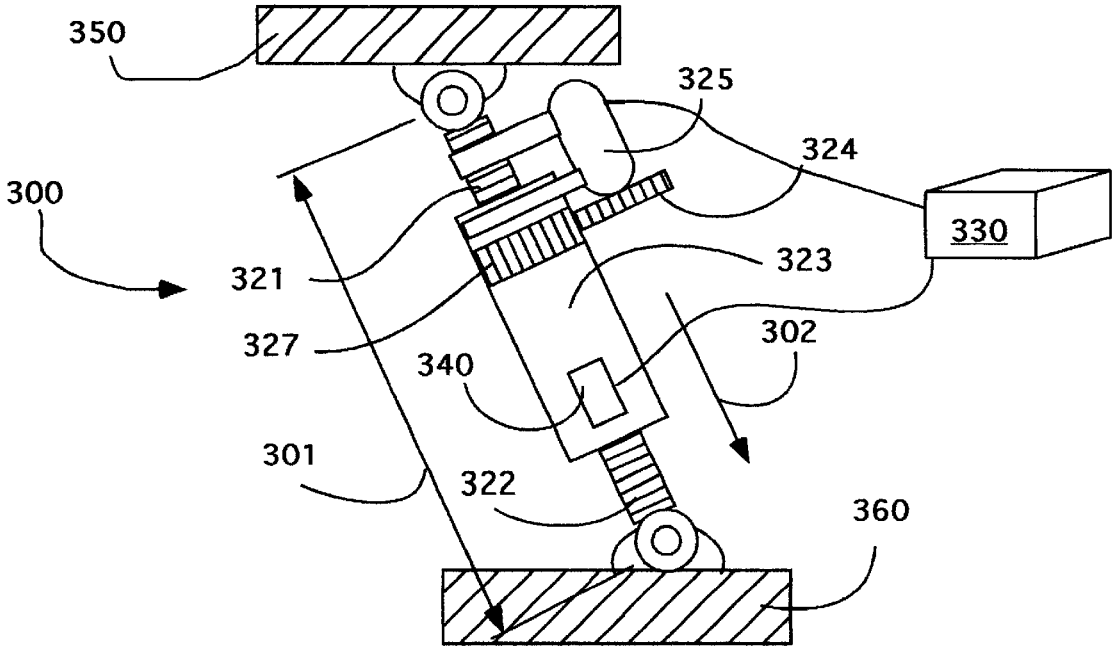
FIG. 3 illustrates an enlarged view of a mechanical embodiment of a single strut with attachment to a drive flange and carrier head.

Referring now to FIG. 3, illustrated is an enlarged view of a mechanical embodiment of a single strut 300 with attachment to a drive flange 350 and carrier head 360. In this embodiment, the strut 300 comprises an upper mechanical strut 321, lower mechanical strut 322, geared turnbuckle 323; gear 324; electric motor 325; a controller 330, and sensor 340. The upper mechanical strut 321 is coupled to the lower mechanical strut 322 by the geared turnbuckle 323. The upper mechanical strut 321 is also coupled to the drive flange 350 and the lower mechanical strut 322 is coupled to the carrier head 360. Gear 324 is coupled to the electric motor 325 while the electric motor 325 is fixedly coupled to the upper mechanical strut 321. The gear 324 interlocks with a geared portion 327 of the geared turnbuckle 323. The length 301 of the strut 300 may be controlled by the controller 330 directing the electric motor 325 to rotate the gear 324, and in turn, the geared turnbuckle 323.

Refer now simultaneously to FIGS. 1 and 3, and assume that multiple struts 300 may now be designated by the struts 120*a*–120*c*. As the turnbuckle 323 is rotated, the corresponding strut 300 is extended or shortened depending upon the direction of rotation. An increase in strut length 301 increases a force 302 in the strut 300. This force 302 is recognized by a change in the sensor 340 that may be a strain gauge 340. The output of the strain gauge 340 may be used to read the force 302 created in each strut 300. The strain gauges (not all shown) are coupled to the controller 330 that interprets the output of each strain gauge and adjusts the force in each strut accordingly. Of course, one who is skilled in the art may readily substitute other sensors while remaining within the greatest scope of the present invention.

The controller 330 compares readings from all strain gauges (others not shown) and makes appropriate adjustments to the forces 121*a*–121*c* being resolved into each strut 120*a*–120*c*. Therefore, more or less force may be applied to a particular area 171*a*–171*c* of the carrier head 110 as needed. Increased force in one strut, e.g., strut 120*b*, will translate into a greater removal rate of material in area 171*b* and thus will assist in obtaining a desired thickness of that area 171*b* of a wafer 170. While a turnbuckle-based system has been described, one who is skilled in the art will readily devise other equivalent mechanical structures suitable for creating the necessary force in the struts involving screw and nut combinations, etc. Additionally, the mechanical system described may also be replaced with piezoelectric transducers capable of generating the forces through an electrical current. One who is skilled in the art is familiar with the principles of creating forces with such piezoelectric transducers.

Thus, various embodiments of a carrier head having adjustable struts to control forces applied to areas of the polishing head have been described. Controlling the forces applied to individual areas enables more precise control of wafer thickness and planarity.

Although the present invention has been described in detail, those skilled in the art should understand that they can make various changes, substitutions and alterations herein without departing from the spirit and scope of the invention in its broadest form.

What is claimed is:

1. A polishing apparatus, comprising:

a carrier head;

rigid members coupled to the carrier head at different points on the carrier head;

a controller coupled to each of the rigid members, the controller configured to regulate forces applied against the carrier head through each of the rigid members; and sensors coupled to the carrier head proximate each of the different points and configured to sense a force applied to the carrier head at each of the different points.

2. The polishing apparatus as recited in claim 1 wherein the rigid members are struts.

3. The polishing apparatus as recited in claim 1 wherein the sensors are selected from the group consisting of:

pressure sensors;

force sensors;

capacitance sensors;

resistance sensors; and piezoelectric sensors.

4. The polishing apparatus as recited in claim 1 further comprising a thickness sensor configured to sense a thickness of a desired layer of a semiconductor wafer.

5. The polishing apparatus as recited in claim 1 wherein each of the rigid members is coupled to a mechanical screw configured to provide a force against the carrier head.

6. The polishing apparatus as recited in claim 5 wherein each of the rigid members includes the mechanical screw.

7. The polishing apparatus as recited in claim 5 wherein the mechanical screw is coupled to a motor that provides a rotation to the mechanical screw, the motor coupled to the controller.

8. The polishing apparatus as recited in claim 1 wherein each of the rigid members is coupled to a pneumatic cylinder configured to provide a force against the carrier head.

9. The polishing apparatus as recited in claim 8 wherein the pneumatic cylinder is coupled to a pneumatic system that provides the force.

10. The polishing apparatus as recited in claim 1 wherein each of the rigid members is coupled to a hydraulic cylinder configured to provide a force against the carrier head.

11. The polishing apparatus as recited in claim 10 wherein the hydraulic cylinder is coupled to a hydraulic system that provides the force.

12. The polishing apparatus as recited in claim 1 wherein each of the rigid members is coupled to a piezoelectric transducer configured to provide a force against the carrier head.

13. The polishing apparatus as recited in claim 12 wherein the piezoelectric transducer is coupled to an electrical system.

14. A method of manufacturing a polishing apparatus, comprising:

providing a carrier head;

coupling struts to the carrier head at different points on the carrier head;

coupling a controller to each of the struts, the controller configured to regulate forces applied against the carrier head through each of the struts; and coupling sensors to the carrier head proximate each of the different points and configured to sense a force applied to the carrier head at each of the different points.

15. The method as recited in claim 14 wherein coupling sensors includes coupling sensors selected from the group consisting of:

pressure sensors;

force sensors;

capacitance sensors;

resistance sensors; and piezoelectric sensors.

16. The method as recited in claim 14 wherein coupling a controller includes coupling a controller comprising a thickness sensor coupled to the carrier head and configured to sense a thickness of a desired layer of a semiconductor wafer.

17. The method as recited in claim 14 wherein coupling struts includes coupling struts wherein each of the struts is coupled to a mechanical screw configured to provide a force against the carrier head.

18. The method as recited in claim 17 wherein coupling struts includes coupling struts wherein each of the struts includes the mechanical screw.

19. The method as recited in claim 17 wherein coupling struts includes coupling struts wherein the mechanical screw is coupled to a motor that provides a rotation to the mechanical screw and further includes coupling the motor to the controller.

20. The method as recited in claim 14 wherein coupling struts includes coupling struts wherein each of the struts is coupled to a pneumatic cylinder configured to provide a force against the carrier head.

21. The method as recited in claim 20 wherein coupling struts includes coupling struts wherein the pneumatic cylinder is coupled to a pneumatic system that provides the force.

22. The method as recited in claim 14 wherein coupling struts includes coupling struts wherein each of the struts is coupled to a hydraulic cylinder configured to provide a force against the carrier head.

23. The method as recited in claim 22 wherein coupling struts includes coupling struts wherein the hydraulic cylinder is coupled to a hydraulic system that provides the force.

24. The method as recited in claim 14 wherein coupling struts includes coupling struts wherein each of the struts is coupled to a piezoelectric transducer configured to provide a force against the carrier head.

25. The method as recited in claim 24 wherein coupling struts includes coupling struts wherein the piezoelectric transducer is coupled to an electrical system.

26. A method of polishing a semiconductor wafer, comprising:

placing a semiconductor wafer on a polishing platen;

polishing the semiconductor wafer with a polishing apparatus having:

a carrier head;

struts coupled to the carrier head at different points on the carrier head;

a controller coupled to each of the struts, the controller configured to regulate forces applied against the carrier head through each of the struts; and sensors coupled to the carrier head proximate each of the different points and configured to sense a force applied to the carrier head at each of the different points; and regulating a force in at least one of the struts during the polishing.

27. The method as recited in claim 26 wherein polishing includes polishing wherein the sensors are selected from the group consisting of:

pressure sensors;

force sensors;

capacitance sensors;

resistance sensors; and piezoelectric sensors.

28. The method as recited in claim 26 wherein regulating includes regulating wherein the force is generated by a system selected from the group consisting of:

a mechanical system;

an electrical system;

a pneumatic system; and a hydraulic system.

* * * * *